US007013771B2

(12) United States Patent
Wu

(10) Patent No.: US 7,013,771 B2
(45) Date of Patent: Mar. 21, 2006

(54) DETACHMENT TOOL FOR PIPE CLAMPING STRAP

(76) Inventor: Pi-Liang Wu, P.O. Box 55-124, Taichung (TW)

( * ) Notice: Subject to any disclaimer, the term of this patent is extended or adjusted under 35 U.S.C. 154(b) by 0 days.

(21) Appl. No.: 10/902,106

(22) Filed: Jul. 30, 2004

(65) Prior Publication Data

US 2006/0021480 A1 Feb. 2, 2006

(51) Int. Cl.
*B25B 11/00* (2006.01)

(52) U.S. Cl. ..... 81/486; 81/9.3; 81/3.27; 81/3.36; 81/3.55; 81/3.56

(58) Field of Classification Search ..... 81/9.3, 81/3.27, 3.36, 3.55, 3.56, 486
See application file for complete search history.

(56) References Cited

U.S. PATENT DOCUMENTS 3,596,686 A * 8/1971 Blumenfeld et al. ..... 81/93
4,423,860 A * 1/1984 Windstrup ..... 296/180
4,619,446 A * 10/1986 Yang ..... 269/88
6,640,666 B1 * 11/2003 Pliley ..... 81/6

* cited by examiner

*Primary Examiner*—Joseph J. Hail, III
*Assistant Examiner*—Shantese McDonald

(57) ABSTRACT

A detachment tool for a pipe clamping strap detachment tool includes a support seat, a fixed jaw, a movable member including a base plate and a movable jaw, and a threaded rod. Thus, the two ear plates of the pipe clamping strap are supported by the fixed jaw and the movable jaw of the movable member rigidly and stably without slip during the detachment process of the pipe clamping strap, thereby facilitating a user detaching the pipe from the pipe clamping strap.

18 Claims, 4 Drawing Sheets

DETACHMENT TOOL FOR PIPE CLAMPING STRAP

BACKGROUND OF THE INVENTION

1. Field of the Invention

The present invention relates to a detachment tool, and more particularly to a detachment tool for a pipe clamping strap.

2. Description of the Related Art

A conventional pipe clamping strap 1 in accordance with the prior art shown in FIG. 1 has a first end formed with a first ear plate 102 and a second end formed with a through hole 101 for passage of the first ear plate 102. The through hole 101 has a side formed with a second ear plate 103. In practice, the pipe clamping strap 1 is clamped on a pipe (not shown) so as to closely cover the pipe. In detachment, the first ear plate 102 and the second ear plate 103 are pressed by a user's two fingers to approach each other to expand the pipe clamping strap 1, thereby releasing and detaching the pipe from the pipe clamping strap 1. However, the user's fingers are easily hurt by the first ear plate 102 and the second ear plate 103 during the detachment process of the pipe clamping strap 1, thereby causing danger to the user.

SUMMARY OF THE INVENTION

The primary objective of the present invention is to provide a detachment tool for releasing a pipe clamping strap.

Another objective of the present invention is to provide a detachment tool, wherein the two ear plates of the pipe clamping strap are supported by the fixed jaw and the movable jaw of the movable member rigidly and stably without slip during the detachment process of the pipe clamping strap, thereby facilitating a user detaching the pipe from the pipe clamping strap.

A further objective of the present invention is to provide a detachment tool, wherein the user needs not to hold the two ear plates of the pipe clamping strap during the detachment process of the pipe clamping strap, thereby preventing the user's hand from being hurt by the two ear plates of the pipe clamping strap so as to protect the user's safety.

In accordance with the present invention, there is provided a detachment tool, comprising:

- a support seat having a guide channel;
- a fixed jaw mounted on the support seat;
- a movable member movably mounted on the support seat and including a base plate movably mounted in the guide channel of the support seat and formed with a screw bore, and a movable jaw extended outward from the base plate and directed toward the fixed jaw; and
- a threaded rod rotatably mounted in the guide channel of the support seat and screwed into the screw bore of the base plate of the movable member to drive the movable member to move relative to the fixed jaw reciprocatingly.

Further benefits and advantages of the present invention will become apparent after a careful reading of the detailed description with appropriate reference to the accompanying drawings.

DETAILED DESCRIPTION OF THE INVENTION

Figure 1:
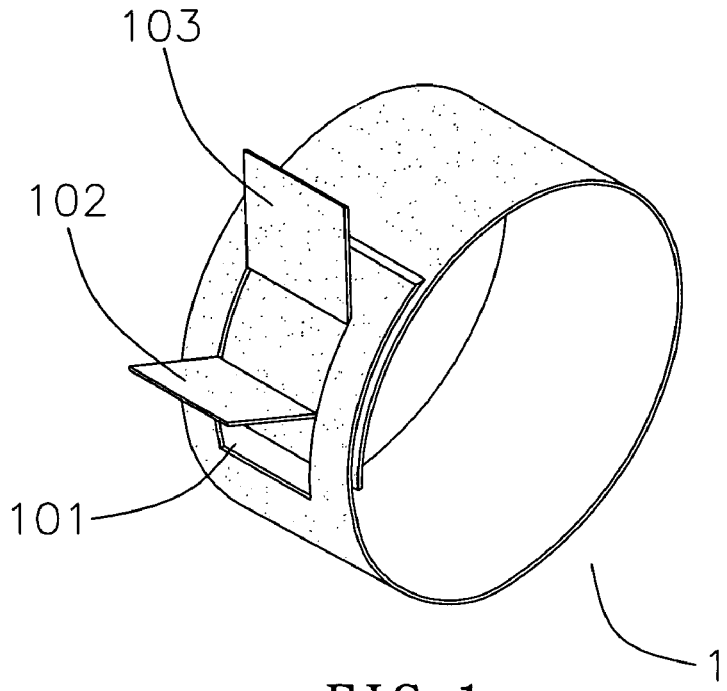
FIG. 1 PRIOR ART
FIG. 1 is a perspective view of a conventional pipe clamping strap in accordance with the prior art.
Figure 2:
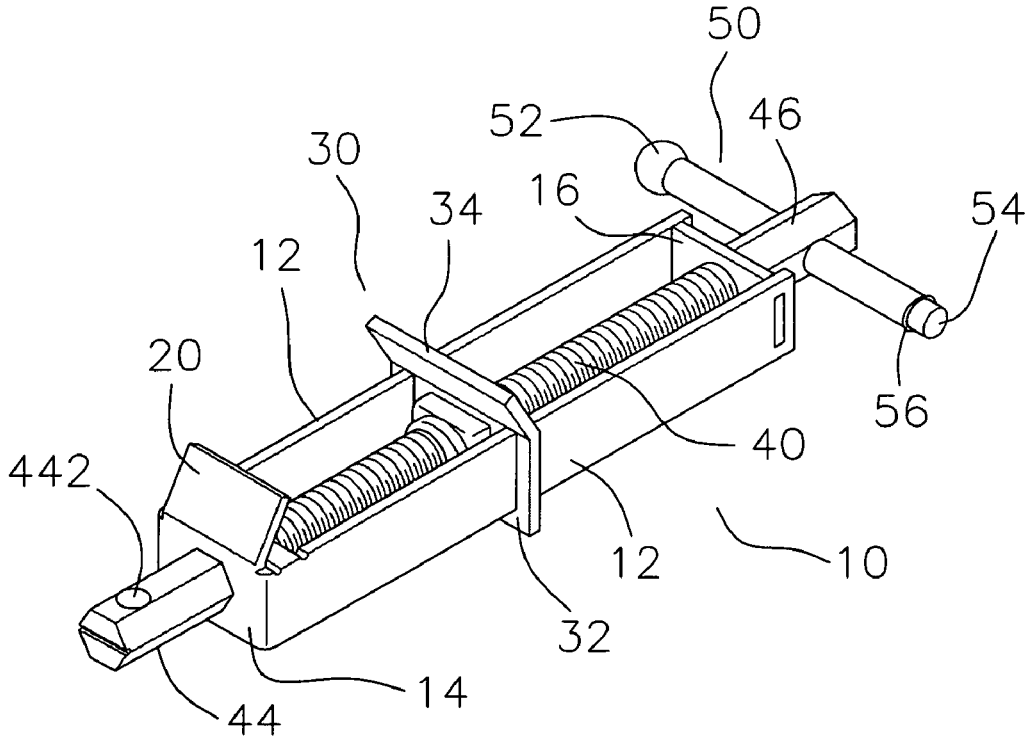
FIG. 2 is a perspective view of a detachment tool in accordance with the preferred embodiment of the present invention.
Figure 3:
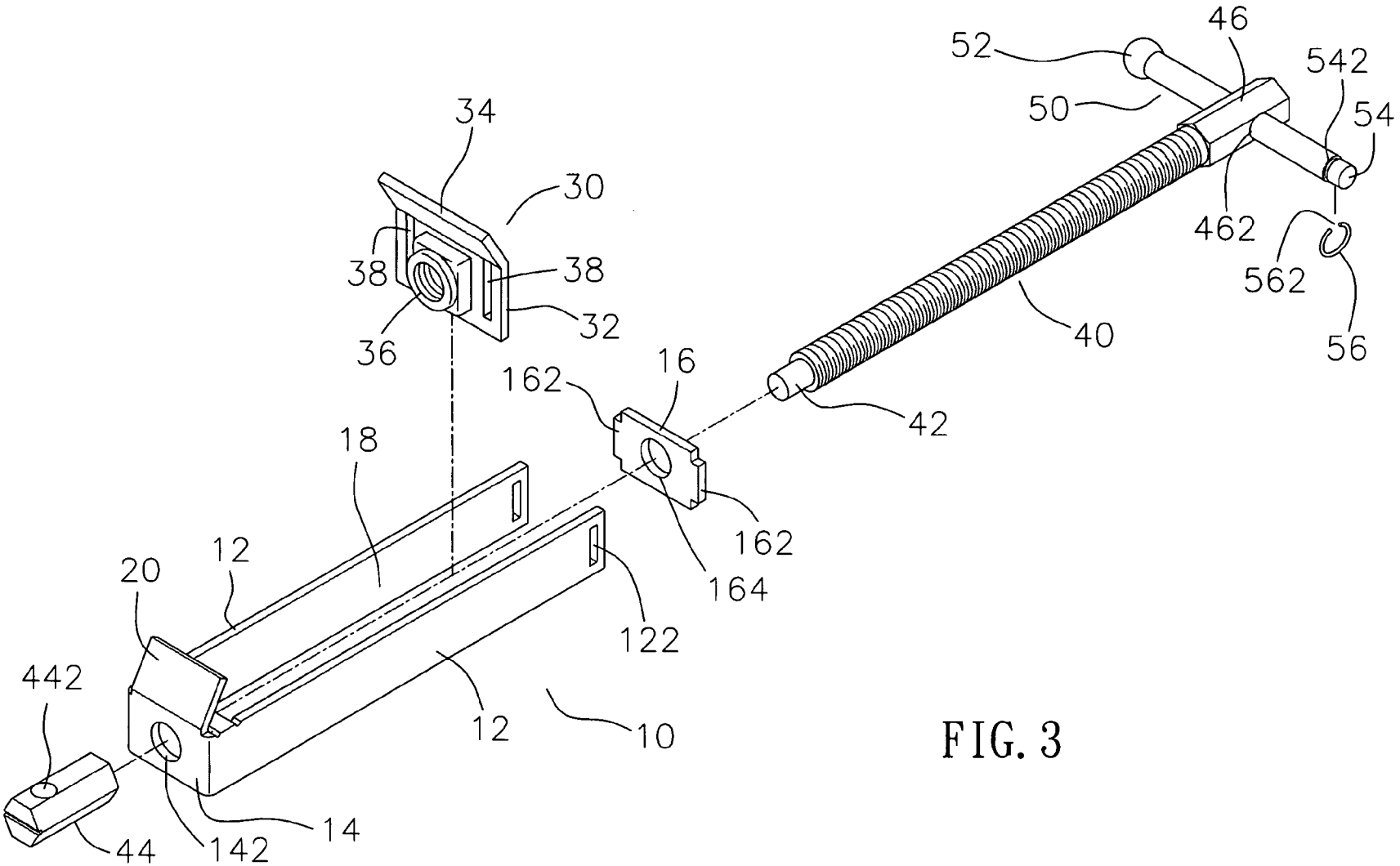
FIG. 3 is an exploded perspective view of the detachment tool as shown in FIG. 2.
Figure 4:
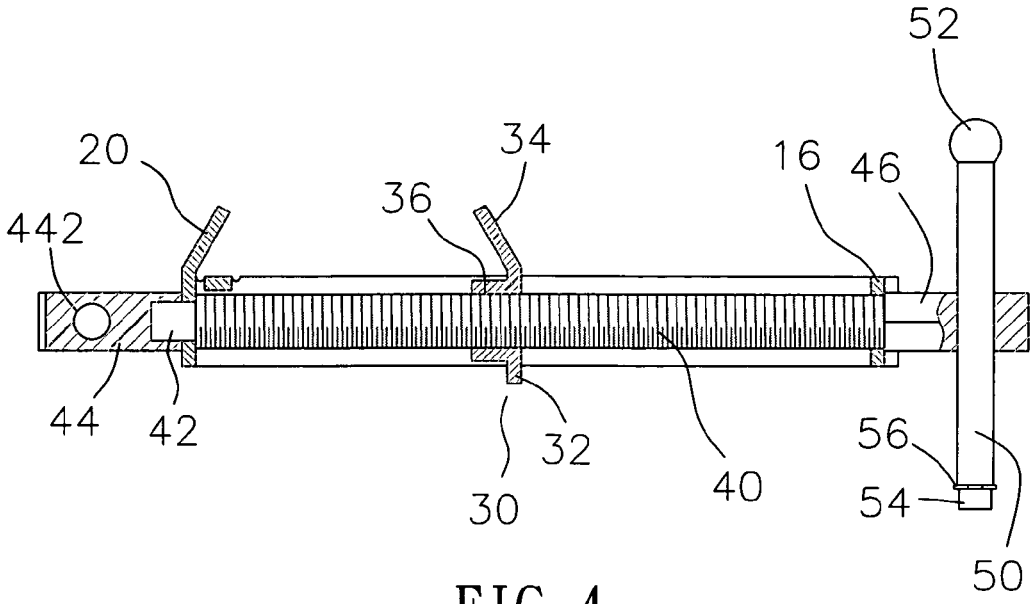
FIG. 4 is a plan cross-sectional view of the detachment tool as shown in FIG. 2.

Referring to the drawings and initially to FIGS. 2–4, a detachment tool for a pipe clamping strap in accordance with the preferred embodiment of the present invention comprises a support seat 10 having a guide channel 18, a fixed jaw 20 mounted on the support seat 10, a movable member 30 movably mounted on the support seat 10 and including a base plate 32 movably mounted in the guide channel 18 of the support seat 10 and formed with a screw bore 36 and a movable jaw 34 extended outward from the base plate 32 and directed toward the fixed jaw 20, and a threaded rod 40 rotatably mounted in the guide channel 18 of the support seat 10 and screwed into the screw bore 36 of the base plate 32 of the movable member 30 to drive the movable member 30 to move relative to the fixed jaw 20 reciprocatingly.

The support seat 10 includes two elongated guide plates 12, a first end plate 14 mounted on a first end of each of the two guide plates 12, and a second end plate 16 mounted on a second end of each of the two guide plates 12. The guide channel 18 of the support seat 10 is defined between the two guide plates 12. The first end plate 14 of the support seat 10 is formed with a first pivot hole 142, and the second end plate 16 of the support seat 10 is formed with a second pivot hole 164 having a diameter greater than that of the first pivot hole 142 of the first end plate 14. The second end of each of the two guide plates 12 of the support seat 10 is formed with an insertion recess 122, and the second end plate 16 of the support seat 10 has two ends each formed with an insertion piece 162 inserted into the insertion recess 122 of a respective one of the two guide plates 12 of the support seat 10.

The fixed jaw 20 is mounted on the first end plate 14 of the support seat 10 and is inclined toward the movable jaw 34 of the movable member 30.

The movable member 30 is movably mounted between the two guide plates 12 of the support seat 10 and is guided by the guide channel 18 of the support seat 10. The base plate 32 of the movable member 30 has two ends each formed with a passage 38 slidably mounted on a respective one of the two guide plates 12 of the support seat 10. The movable jaw 34 of the movable member 30 is inclined toward the fixed jaw 20.

A first rotation seat 44 is rotatably mounted on a first end of the support seat 10 and fixed on a first end of the threaded rod 40 to drive the threaded rod 40 to rotate, and a second rotation seat 46 is rotatably mounted on a second end of the support seat 10 and fixed on a second end of the threaded rod 40 to drive the threaded rod 40 to rotate. Each of the first rotation seat 44 and the second rotation seat 46 is a polygonal block and preferably has a hexagonal shaped cross-section.

The first end of the threaded rod 40 is rested on the first end plate 14 of the support seat 10 and is formed with a pivot shaft 42 extended through and protruded outward from the first pivot hole 142 of the first end plate 14 of the support seat 10, and the first rotation seat 44 is secured on the pivot shaft 42 of the threaded rod 40. The first rotation seat 44 is formed with an insertion hole 442. The second end of the threaded rod 40 is extended through the second pivot hole 164 of the second end plate 16 of the support seat 10, and the second rotation seat 46 is secured on the second end of the threaded rod 40 and rested on the second end plate 16 of the support seat 10. The second rotation seat 46 is formed with an insertion hole 462.

An operation rod 50 is selectively mounted on either one of the first rotation seat 44 and the second rotation seat 46 to rotate the first rotation seat 44 or the second rotation seat 46 so as to drive the threaded rod 40 to rotate. The operation rod 50 has a first end formed with a mounting shaft 54 having a reduced diameter and a second end formed with a spherical head 52. The mounting shaft 54 of the operation rod 50 is formed with an annular snap groove 542.

A snapping member 56 is mounted in the snap groove 542 of the mounting shaft 54 of the operation rod 50. The snapping member 56 is made of elastic material having an oblong cross-section. The snapping member 56 is substantially C-shaped and has a gap 562 defined between two ends of the snapping member 56. In addition, the snapping member 56 is protruded outward from the snap groove 542 of the mounting shaft 54 of the operation rod 50 by its elasticity and is retracted into the snap groove 542 of the mounting shaft 54 of the operation rod 50 when the snapping member 56 is compressed.

Figure 5:
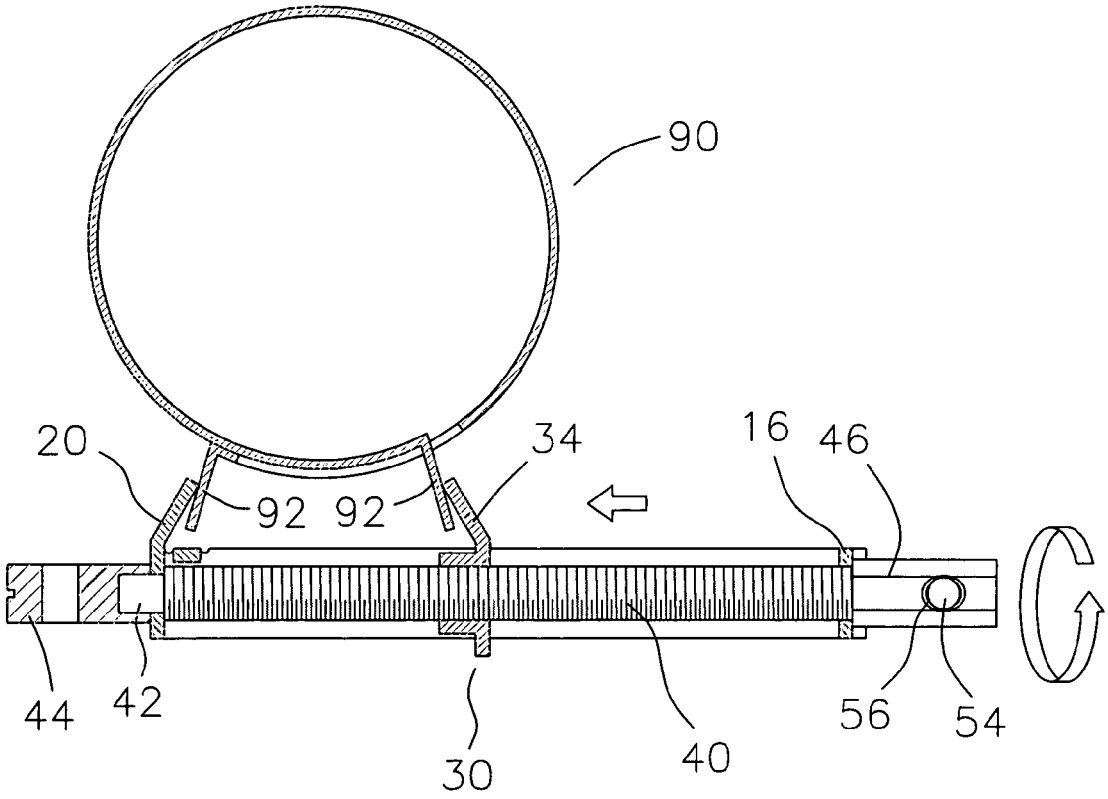
FIG. 5 is a schematic operational view of the detachment tool as shown in FIG. 4.

In operation, referring to FIGS. 2–5, the detachment tool is mounted on a pipe clamping strap 90 having two protruding ear plates 92. A pipe (not shown) is initially clamped in the pipe clamping strap 90. In practice, as shown in FIG. 5, the fixed jaw 20 is rested on one of the two ear plates 92 of the pipe clamping strap 90. Then, the second rotation seat 46 is rotated by the operation rod 50 to drive and rotate the threaded rod 40 so as to move the movable member 30, so that the movable jaw 34 of the movable member 30 is moved toward the fixed jaw 20 to press the other ear plate 92 of the pipe clamping strap 90. In such a manner, the two ear plates 92 of the pipe clamping strap 90 approach each other by push of the movable jaw 34 of the movable member 30 to expand the pipe clamping strap 90, thereby releasing and detaching the pipe from the pipe clamping strap 90.

Thus, the two ear plates 92 of the pipe clamping strap 90 are supported by the fixed jaw 20 and the movable jaw 34 of the movable member 30 rigidly and stably without slip during the detachment process of the pipe clamping strap 90, thereby facilitating a user detaching the pipe from the pipe clamping strap 90. In addition, the user needs not to hold the two ear plates 92 of the pipe clamping strap 90 during the detachment process of the pipe clamping strap 90, thereby preventing the user's hand from being hurt by the two ear plates 92 of the pipe clamping strap 90 so as to protect the user's safety.

Figure 6:
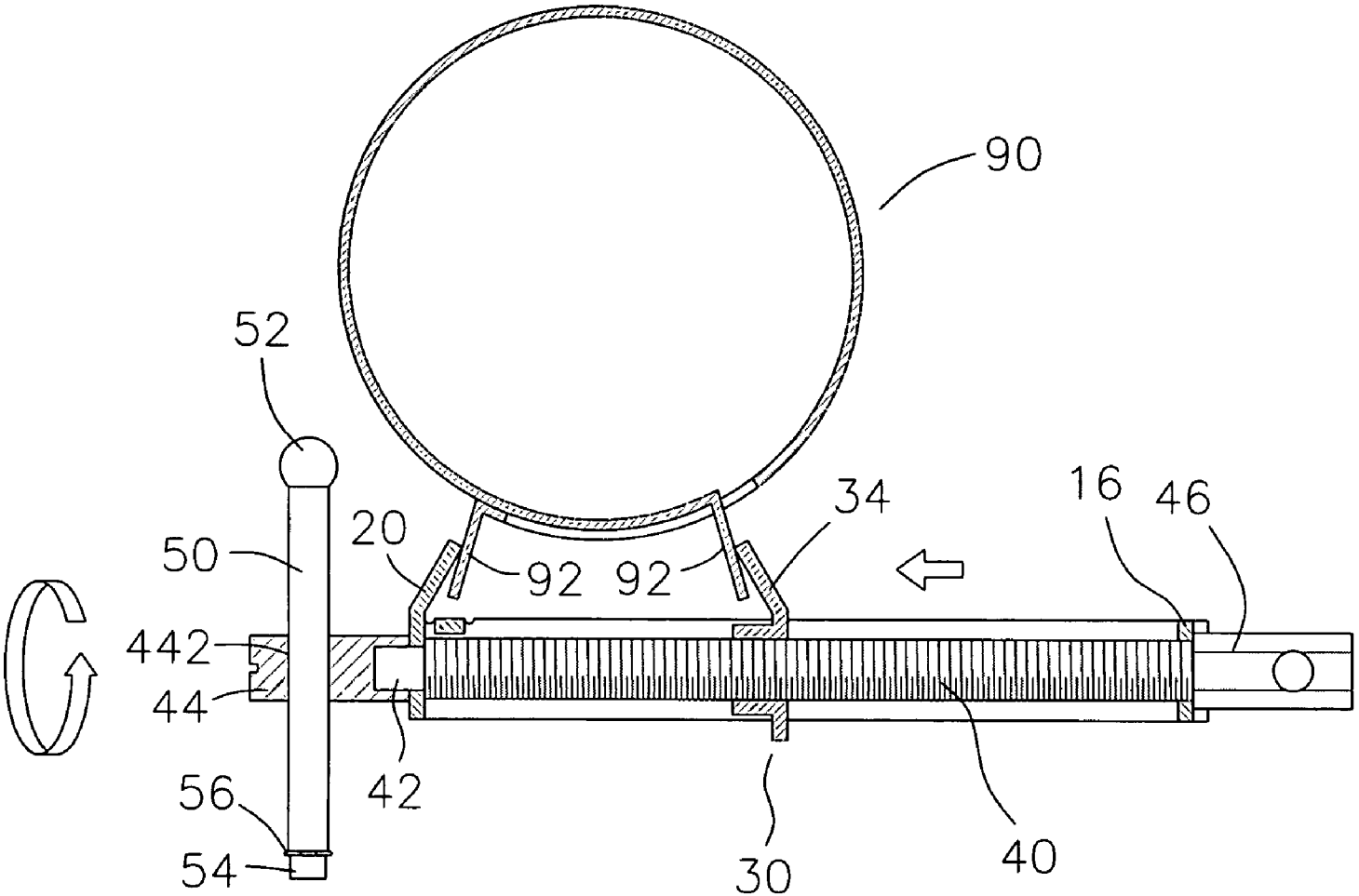
FIG. 6 is a schematic operational view of the detachment tool as shown in FIG. 4.

Alternatively, as shown in FIG. 6, the operation rod 50 is detached from the second rotation seat 46 and is inserted into the first rotation seat 44, so that the first rotation seat 44 is rotated by the operation rod 50 to drive and rotate the threaded rod 40 so as to move the movable member 30.

Alternatively, the operation rod 50 is detached from the first rotation seat 44 and the second rotation seat 46, and either one of the first rotation seat 44 and the second rotation seat 46 is rotated by a wrench (not shown) to drive and rotate the threaded rod 40 so as to move the movable member 30 without aid of the operation rod 50.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A detachment tool, comprising:

a support seat having a guide channel, the support seat including two elongated guide plates, a first end plate mounted on a first end of each of the two guide plates, and a second end plate mounted on a second end of each of the two guide plates, the second end of each of the two guide plates of the support seat being formed with an insertion recess, and the second end plate of the support seat having two ends each formed with an insertion piece inserted into the insertion recess of a respective one of the two guide plates of the support seat;

a fixed jaw mounted on the support seat;

a movable member movably mounted on the support seat and including a base plate movably mounted in the guide channel of the support seat and formed with a screw bore, and a movable jaw extended outward from the base plate and directed toward the fixed jaw; and a threaded rod rotatably mounted in the guide channel of the support seat and screwed into the screw bore of the base plate of the movable member to drive the movable member to move relative to the fixed jaw reciprocatingly.

2. The detachment tool in accordance with claim 1, wherein the guide channel of the support seat is defined between the two guide plates.

3. The detachment tool in accordance with claim 1, wherein the fixed jaw is mounted on the first end plate of the support seat.

4. The detachment tool in accordance with claim 1, wherein the fixed jaw is inclined toward the movable jaw of the movable member.

5. The detachment tool in accordance with claim 1, wherein the movable member is movably mounted between the two guide plates of the support seat and is guided by the guide channel of the support seat.

6. The detachment tool in accordance with claim 1, wherein the base plate of the movable member has two ends each formed with a passage slidably mounted on a respective one of the two guide plates of the support seat.

7. The detachment tool in accordance with claim 1, wherein the movable jaw of the movable member is inclined toward the fixed jaw.

8. The detachment tool in accordance with claim 1, further comprising a first rotation seat rotatably mounted on a first end of the support seat and fixed on a first end of the threaded rod to drive the threaded rod to rotate, and a second rotation seat rotatably mounted on a second end of the support seat and fixed on a second end of the threaded rod to drive the threaded rod to rotate.

9. The detachment tool in accordance with claim 8, further comprising an operation rod selectively mounted on either one of the first rotation seat and the second rotation seat to rotate the first rotation seat or the second rotation seat so as to drive the threaded rod to rotate.

10. The detachment tool in accordance with claim 9, wherein the operation rod has a first end formed with a mounting shaft having a reduced diameter and a second end formed with a spherical head.

11. The detachment tool in accordance with claim 10, wherein the mounting shaft of the operation rod is formed with an annular snap groove, and the detachment tool further comprises a snapping member mounted in the snap groove of the mounting shaft of the operation rod.

12. The detachment tool in accordance with claim 11, wherein the snapping member is made of elastic material having an oblong cross-section.

13. The detachment tool in accordance with claim 11, wherein the snapping member is substantially C-shaped and has a gap defined between two ends of the snapping member.

14. The detachment tool in accordance with claim 11, wherein the snapping member is protruded outward from the snap groove of the mounting shaft of the operation rod by its elasticity and is retracted into the snap groove of the mounting shaft of the operation rod when the snapping member is compressed.

15. The detachment tool in accordance with claim 8, wherein each of the first rotation seat and the second rotation seat is a polygonal block.

16. The detachment tool in accordance with claim 8, wherein each of the first rotation seat and the second rotation seat has a hexagonal shaped cross-section.

17. The detachment tool in accordance with claim 8, wherein the first rotation seat is formed with an insertion hole.

18. The detachment tool in accordance with claim 8, wherein the second rotation seat is formed with an insertion hole.

* * * * *